US008752730B2

(12) United States Patent
Newman et al.

(10) Patent No.: US 8,752,730 B2
(45) Date of Patent: Jun. 17, 2014

(54) VISCOUS MATERIAL SELECTIVE PACKET METHOD

(75) Inventors: Sven Newman, Burlingame, CA (US); Jessica W. Wolma, Huntersville, NC (US); Anita G. Mooy, Charlotte, NC (US); Jeffrey J. Davis, Cornelius, NC (US); Phillip Neal Sharp, Mountain View, CA (US); David C. Thomsen, San Mateo, CA (US)

(73) Assignee: Momentive Performance Materials Inc., Waterford, NY (US)

( * ) Notice: Subject to any disclaimer, the term of this patent is extended or adjusted under 35 U.S.C. 154(b) by 1152 days.

(21) Appl. No.: 11/613,661

(22) Filed: Dec. 20, 2006

(65) Prior Publication Data

US 2008/0149667 A1 Jun. 26, 2008

(51) Int. Cl.
*B65D 83/00* (2006.01)

(52) U.S. Cl.
USPC ..... 222/1; 222/107

(58) Field of Classification Search
USPC ..... 222/107, 95, 1, 103, 92; 206/223, 277, 206/229; 53/459
See application file for complete search history.

(56) References Cited

U.S. PATENT DOCUMENTS

| | | | | | |
|---|---|---|---|---|---|
| 2,390,822 | A | * | 12/1945 | Wren | 222/572 |
| 2,723,779 | A | * | 11/1955 | Parker et al. | 222/104 |
| 2,878,967 | A | * | 3/1959 | Duke | 222/107 |
| 3,354,924 | A | * | 11/1967 | Birrell et al. | 220/666 |
| 3,635,376 | A | * | 1/1972 | Hellstrom | 222/107 |
| 3,986,640 | A | | 10/1976 | Redmond | |
| 4,148,417 | A | | 4/1979 | Simmons | |
| 4,236,652 | A | | 12/1980 | Beguhn | |
| 4,671,026 | A | | 6/1987 | Wissinger | |
| 4,817,344 | A | | 4/1989 | Wissinger | |
| 4,863,014 | A | | 9/1989 | Simmons | |
| 4,974,732 | A | | 12/1990 | Sullivan | |
| 5,034,455 | A | | 7/1991 | Stein | |
| 5,180,063 | A | | 1/1993 | Sakno | |
| 5,228,782 | A | | 7/1993 | Imer | |
| 5,373,965 | A | * | 12/1994 | Halm et al. | 222/92 |
| 5,654,082 | A | | 8/1997 | Kagawa | |
| 6,090,451 | A | | 7/2000 | Barth | |
| 6,241,287 | B1 | | 6/2001 | Best | |
| 6,269,654 | B1 | | 8/2001 | Murray | |
| 6,305,132 | B1 | | 10/2001 | Smith | |

(Continued)

FOREIGN PATENT DOCUMENTS

| | | |
|---|---|---|
| JP | 2001-018989 | 1/2001 |
| WO | 92/09494 | 6/1992 |
| WO | PCT 2009/060541 | 9/2009 |

OTHER PUBLICATIONS

JP 2001—18989 english translation.*

*Primary Examiner* — Kevin P Shaver
*Assistant Examiner* — Robert Nichols, II
(74) *Attorney, Agent, or Firm* — Joseph E. Waters

(57) ABSTRACT

A viscous material dispenser comprises a container having at least two opposing sidewalls; a first closure end; and a second closure end; the sidewalls and closure ends defining an enclosure, and at least one closure end comprising an expressing shape and at least one sidewall comprising a crease running from the expressing shaped closure end to the other closure end to permit folding the container at the crease to express a content from an interior of the container through the expressing shaped closure end to an exterior.

10 Claims, 2 Drawing Sheets

(56) References Cited

U.S. PATENT DOCUMENTS

| | | | | |
|---|---|---|---|---|
| 6,305,577 | B1 | 10/2001 | Fillmore | |
| 6,451,440 | B2 | 9/2002 | Atwood | |
| 6,557,731 | B1 * | 5/2003 | Lyon et al. | 222/94 |
| 6,659,278 | B1 | 12/2003 | Velliquette | |
| 6,662,948 | B1 | 12/2003 | Velliquette | |
| 7,241,066 | B1 * | 7/2007 | Rosen et al. | 401/183 |
| 2001/0038020 | A1 | 11/2001 | Schalow | |
| 2001/0048198 | A1 | 12/2001 | Dulin | |
| 2001/0049427 | A1 | 12/2001 | Atwood et al. | |
| 2003/0089625 | A1 | 5/2003 | Moodie | |
| 2004/0226968 | A1 | 11/2004 | LaFond | |
| 2005/0152624 | A1 | 7/2005 | Versluys | |
| 2005/0217034 | A1 | 10/2005 | Miller | |
| 2006/0226171 | A1 | 10/2006 | Sternberg | |
| 2007/0266901 | A1 * | 11/2007 | Rance et al. | 106/501.1 |
| 2007/0272705 | A1 * | 11/2007 | Beine et al. | 222/107 |
| 2008/0197042 | A1 | 8/2008 | Ullrich | |
| 2009/0110856 | A1 * | 4/2009 | Gummaraju et al. | 428/35.7 |

* cited by examiner

VISCOUS MATERIAL SELECTIVE PACKET METHOD

BACKGROUND OF THE INVENTION

The invention relates to a viscous material dispenser, kit and method and more particularly to a dispenser, kit and method for dispensing a sealant.

Viscous materials can include sealant, mastic, adhesive, glazing, caulk, grout and glue compositions. Typically, such viscous materials are packaged, stored or commercialized in cardboard containers or plastic dispensers or cartridges that are adapted to be loaded into an extrusion device such as a caulking gun. These viscous materials include silicone sealants and caulks that are used in building and construction applications. Some of these compositions are referred to as room temperature vulcanizable (RTV) compositions. They may include a moisture-curable polyorganosiloxane polymer, filler, and a condensation cure catalyst. When used as sealants, these compositions can be packaged in a moisture impervious tube and applied to a substrate by extrusion from the packaging tube.

There are difficulties associated with these containers. For example, some materials are merchandised in cartridges for loading into a caulk dispenser or gun. The dispenser or gun is another item that must be purchased, stored, cleaned and maintained as part of the caulking process. The dispenser or gun may be cumbersome and difficult to operate, especially in constrained spaces in buildings under construction. Also, the dispensing device may require significant hand strength, which adds challenge to dispensing and laying a clean sealant bead.

In one process, a quantity of sealant is expressed from a dispensing tube or cartridge directly to a device to seal the area when dried. Typically, the dispensing tube or cartridge will contain more material than an amount required for a particular sealing job. Usually some unused portion of the tube remains after a required amount has been dispensed. The dispensing tube with the unused portion is discarded or is saved for futures use. Discarding is uneconomical and may be highly undesirable for environmental reasons. At present, there is no known recycling available for the wide variety of sealant compositions available on the market.

If the container with residual sealant is not discarded, it will need to be capped to save the material without setting for future use. But, the sealant may include a volatile component that will evaporation to harden residual material. Other sealants may be settable from exposure to atmosphere oxygen. And unless the container is correctly reclosed, the residual material will be lost.

Some dispensing containers are merchandised with a nozzle-engaging, snap-fit bead and groove or screw thread to provide a secure fit to the container body. But these caps are fragile pieces that are easily split or otherwise damaged from overtightening. Or, the snap-fit bead and groove may not provide an enduring reclose fit until the time when the tube is next required for a caulk job. Some informal capping devices have included the placing of a nail into the tube opening, to effect a plug type reclosure. Or, the container cap may be merchandised with a plug member to provide this function. But frequently, these solutions do not prevent content hardening for more than a short period of time.

Other reclosing approaches have included wrapping the container tip with aluminum foil or plastic wrap, secured with a rubber band and enclosing the entire container in a sealable plastic packet. But, oftentimes these mechanisms do not work because the packets rupture or the packets contain enough air to dry the tube contents. And, a foil or wrap can not be closely and tightly wrapped around the tube and nozzle without air gap.

There is a need for a viscous material container that overcomes the problems of waste and difficulty of use of current dispensers. Also, many merchandising containers are unduly expensive. There is a need for a reasonably priced solution in these viscous material container problems.

BRIEF DESCRIPTION OF THE INVENTION

The invention provides a viscous material dispenser, method and kit to overcome current problems of waste, cost and difficulty of use.

The invention can be described as a viscous material dispenser, comprising a container having at least two opposing sidewalls; a first closure end; and a second closure end; the sidewalls and closure ends defining an enclosure, and at least one closure end comprising an expressing shape and at least one sidewall comprising a crease running from the expressing shaped closure end to the other closure end to permit folding the container at the crease to express a content from an interior of the container through the expressing shaped closure end to an exterior.

In an embodiment, the invention is a method of applying a sealant, comprising: providing a container having at least two opposing sidewalls; a first closure end; and a second closure end; the sidewalls and closure ends defining an enclosure including a container sealant, and at least one closure end comprising an expressing shape and at least one sidewall comprising a crease running from the expressing shaped closure end to the other end; and folding the container at the crease to express the sealant from the container through the expressing shaped closure end to an exterior.

In another embodiment, the invention is a sealant kit, comprising: a plurality of sealed packets having a crease along an axis of at least one packet; and a sealant contained within the at least one packet.

And in another embodiment, the invention is a method of applying a sealant, comprising: identifying a sealant job; selecting a packet having a quantity of sealant to accomplish the job without substantial unused sealant; and expressing sealant from the packet to the job.

DETAILED DESCRIPTION OF THE INVENTION

The term sealant as used herein includes an entire variety of caulks including silicones, latex and acrylic caulk; filler compounds; adhesive or mastic-type materials, such as stucco, concrete and cementious-material patching and crack filling compounds; gasketing compounds; gutter, flashing, skylight, or fish tank seam or sealant compounds; butyl or rubber sealants, cements and caulk; roof cements; panel and construction adhesives; glazing compounds and caulks; gutter and lap sealants; silica gel-based firebrick, masonry and ceramic crack fillers and cements; silicon-based glues; ethylene-glycol-containing latex glazing compounds; and the like.

One preferred sealant is an organopolysiloxane room temperature vulcanizable (RTV) composition. The room temperature vulcanizable silicone elastomer composition can contain a silanol stopped base polymer or elastomer, reinforcing and/or extending filler, cross-linking silane and cure catalyst. These RTV compositions are prepared by mixing diorganopolysiloxanes having reactive end groups with organosilicon compounds that possess at least three hydrolyzably reactive moieties per molecule. The known RTV compositions are widely used as elastic sealing materials for applications involving the gaps between various joints such as the gaps between the joints of building materials, the joints between structural bodies and building materials in buildings, between the bathtub and wall or floor, cracks on tiles in bathrooms, gaps in the bathroom such as those around the washbasin and those between the washbasin supporting board and the wall, gaps around the kitchen sink and the vicinity, between panels in automobiles, railroad vehicles, airplanes, ships, gaps between prefabricated panels in various electric appliances, machines, and the like. Room temperature vulcanizable silicone sealants thus may be utilized in a wide variety of caulking and sealing applications.

Features of the invention will become apparent from the drawings and following detailed discussion, which by way of example without limitation describe preferred embodiments of the invention.

Figure 1:
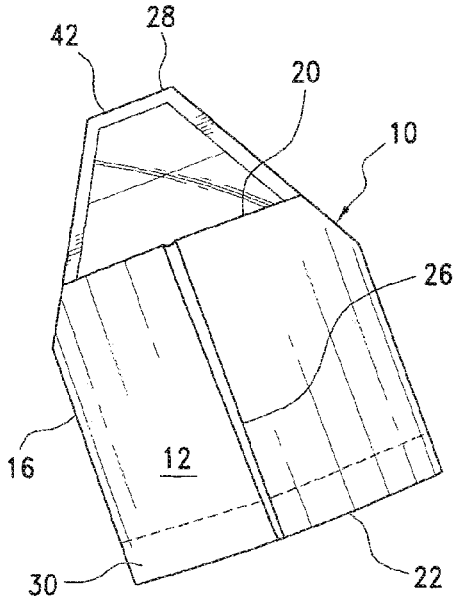
FIG. 1 is a front elevation view of a packet.
Figure 2:
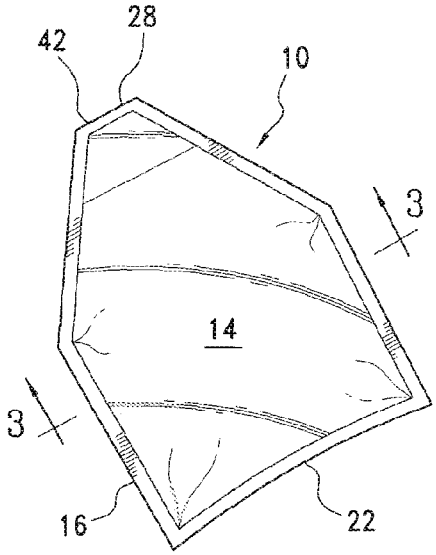
FIG. 2 is a rear elevation view.
Figure 3:
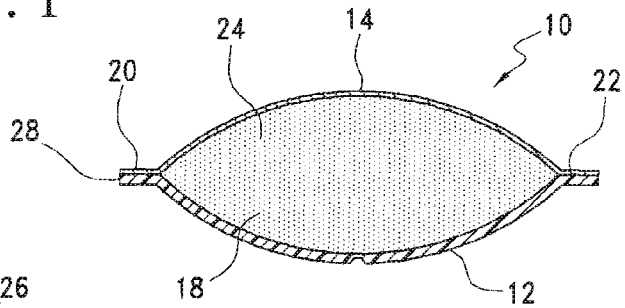
FIG. 3 is a cut away view of the packet through 3-3 of FIG. 2.

FIG. 1, FIG. 2 and FIG. 3 illustrate an embodiment of the invention. FIG. 1 is front elevation of a viscous material dispenser according to the invention. The dispenser is in the form of a packet 10. FIG. 2 is an elevation of the packet 10 from a back side. The packet 10 comprises two sidewalls of plastic or foil film, a top sidewall 12 and a bottom sidewall 14. The sidewalls 12, 14 can be heat-sealed or otherwise connected together along edge 16 to form a pouch 18 as shown in FIG. 3 with a first closure end 20 and a second closure end 22 that form an expressing shape tip 42. Or, the top sidewall 12 and bottom sidewall 14 can be from a single film that is folded into the pouch 18 shape. The film material can be impermeable or only slightly permeable to water vapor and oxygen to ensure product vitality. Preferably the material has a permeability rating of 1 or lower. Suitable film materials include a plastic film, such as low-density polyethylene or other thermoplastic or foil film material. The top sidewall 12 of the packet 10 includes a semi-rigid plastic backing having a crease 26 running longitudinally to the packet 10 from the second closure end 22 toward the first closure end 22. A crease is marked into the backing surface. to facilitate longitudinal folding of the packet 10, as hereinafter described. The crease can be a pressed, folded, wrinkled line or score.

FIG. 3 is a cut away side view of the packet 10 showing pouch 18 containing a sealant 24. The top sidewall 12 can be pleated (not shown) to allow for an increased volume of sealant 24. The packet 10 is creased 26 in the middle to allow for folding as hereinafter described. Nozzle 28 is formed from the tapering end of bottom film 14. The nozzle 28 can be a heat seal closure that can be opened by tearing or cutting with scissors or a knife or simply from pressure of sealant 24 expanding into and then from the nozzle 28. Or in an embodiment, the nozzle 28 can be closed by serrated embossing to provide for easy tear opening.

A portion 30 of the dispenser toward the second closure end 22 can comprise a more rigid or thicker material to impart added structure and strength. For example, the portion 30 can comprise a multiple laminated film that is the same film as the rest of the dispenser. Or, the portion 30 can comprise a different film that is more dense than the film of the rest of the dispenser.

Figure 4:
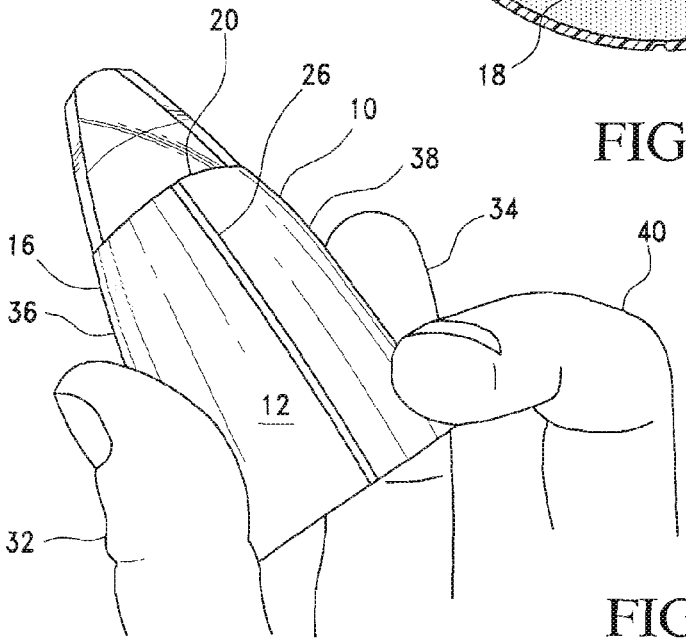
FIG. 4 and FIG. 5 are schematic perspective views of a use of the packet.
Figure 5:
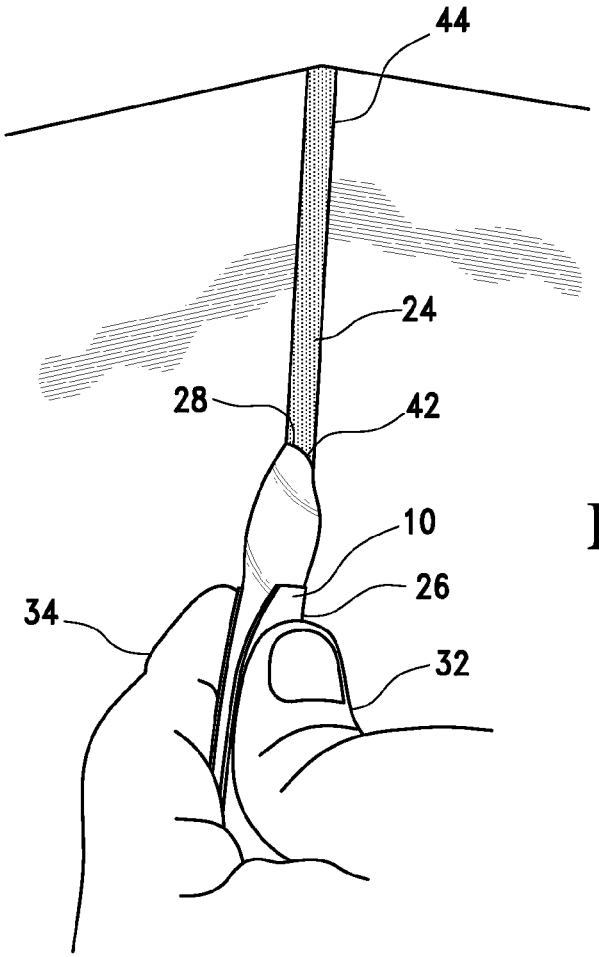

FIG. 4 and FIG. 5 illustrate an application method using the packet 10 of FIG. 1, FIG. 2 and FIG. 3. As illustrated, the packet 10 can be grasped with thumb 32 and second finger 34 located on opposing sides 36, 38 of packet 10 edge 16. Then the packet 10 is folded along crease 26 by applying a force with the thumb 32 and second finger 34 to the opposing edges 36, 38. Folding can be facilitated by a user imposing the length of an index finger 40 against the crease 26 while side force is applied by thumb 32 and second finger 34. The folding drives enclosed sealant 24 from within pouch 18 up through first closure end 20 to be expressed through nozzle 28. Initially, the sealant 24 can be contained within the pouch 18 of the packet 10 and the nozzle 28 can be flat and devoid of sealant 24. But, when the packet 10 is folded and pressed as shown in FIG. 5, the sealant is forced into the nozzle 28, which becomes conical in shape. The conical shape provides increased stability for further controlling the expressing of sealant 24 out the nozzle 28 tip to form a desired sealant bead 44 shape. The substantially rigid structure formed from the overfolding of two sides of the packet 10 can be firmly held while expressing to maneuver the packet 10 and to control location and shape of an applied sealant bead. The nozzle 24 can be shaped to allow sealant to fill the rest of the nozzle and flow from the tip. The nozzle can be shaped to an appropriate bead size, for example, $1/8^{th}$ inch in diameter. The user can further regulate bead size by applied pressure and speed.

Figure 6:
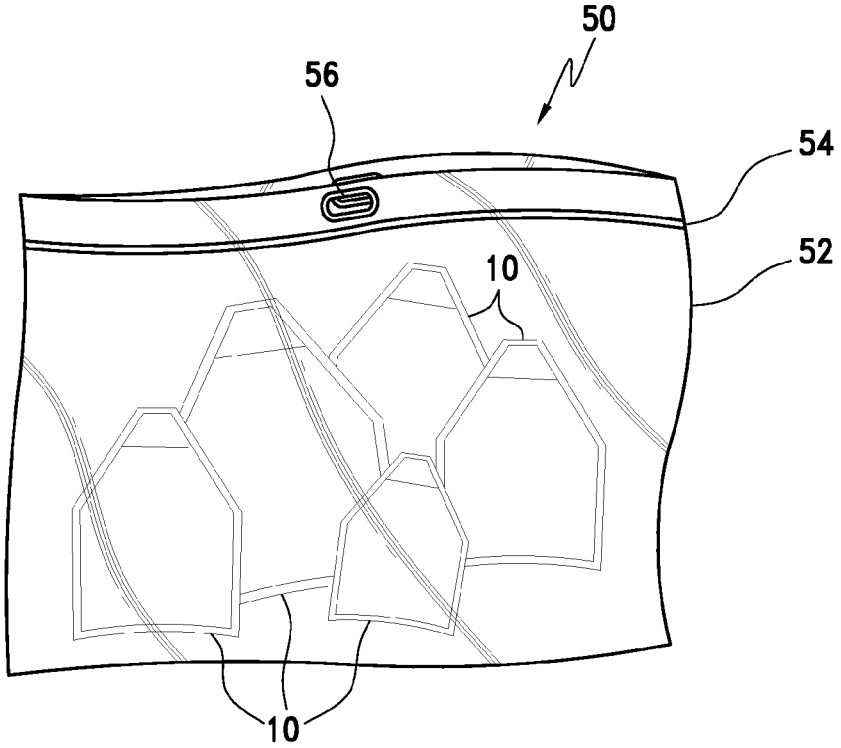
FIG. 6 is a perspective view of a kit with a plurality of packets.

The size of packet 10 can vary but can be about 20 cm by 15 cm or smaller. For example, FIG. 6 illustrates an embodiment of the invention wherein a plurality of packets 10 are provided in a kit 50. The kit 50 includes bag 52 sealable at seal 54 and with eye 56 for hanging when merchandised. The plurality of packets 10 can be the same shape or a variety of shapes or the same size or a variety of sizes, for example 8 cm×6 cm or 4 cm by 2 cm to provide measured amounts of sealant for a variety of jobs. The kit 50 provides a variety of packets 10 so that one packet 10 can be selected to match the requirements of any particular job.

A selected packet from a kit of the invention can provide a desired amount of sealant for any particular job. No caulk gun is needed to apply the sealant. Indeed, no extra tools or materials are needed. The packet is relatively small and easily maneuverable to apply an appropriate bead. The packet requires little application force for dispensing and in most instances, sealant can be fully dispensed by one hand. Saving left over caulk is eliminated. Both kit and packet packaging are inexpensive.

The following Example is illustrative and should not be construed as a limitation on the scope of the claims.

Example 1

Packet samples are evaluated to establish a design for dispensing a viscous material.

The samples are constructed from clear polypropylene Ziploc® packets, thin (<1 mm) black polypropylene and polyethylene sheet and acrylic thin film (<1 mm). The sheet materials are formed and heat sealed into packet shapes by first cutting oversized top and bottom rectangular shapes with triangular ends and heat sealing the pieces together with the triangular ends at one side to form a nozzle. Some of the packets are formed with gussets. The gussets are formed by folding the film at the packet sides and bottom.

Excess material is cut away from the packet after forming. Each packet is filled with material and then heat sealed to form an enclosure. The packets vary in length from about 4 cm to 20 cm, in width from about 2 cm to 15 cm and in thickness (filled with material) from about 0.5 to 2 cm. The packets are filled with acrylic caulk or silicone sealant.

A panel of evaluators is assembled to evaluate each packet from an array of 20 to 30. The packets are evaluated for content integrity and ease and control of material expression. In the evaluation, the panel visually and tactilely inspects each packet before dispensing material. Then members of the panel fold each packet to express its contents. The panel notes ease of control of expression of the material bead onto a test cardboard. Also, the panel observes any failure in packet integrity.

The packets are evaluated for dispersing both acrylic caulk and silicone sealant. The panel practices multiple dispensing for each configured packet. The panel then approves a selection of packets for next step evaluation. The process is reiterated with successive packets constructed according to characteristics of successful packets from a round of a previous evaluation.

The panel identifies packet designs that do not fully fill with material, do not form a round orifice for expressing a uniform bead and are insufficiently flexible to fully fill. Some expressing faults are addressed by changing nozzle angle and length in packets for subsequent evaluation rounds. Some first round designs are observed as too flimsy to allow for fine control needed to dispense a continuous smooth bead of material. This is addressed by (1) making one of the surfaces of the packet out of a more rigid plastic sheet, and (2) modifying user interaction to fold the packet along the crease length to provide an even more rigid dispensing structure.

Some designs are noted as having too thin a film. With these packets, the material resists sliding inside the packet thus making it difficult to completely express packet contents. This problems is addressed with a gusset designed packet to increase the volume of the packet while maintaining or decreasing the packet internal surface area.

A creased semi-rigid plastic backing for the packet is determined as a best design to hold a desired quantity of material and to ease folding for dispensing. The packet is sized overall (7 cm×5 cm×1.5 cm) to be manipulated to completely express material with one hand. The selected dispenser nozzle has a longer, 2 cm and narrower, 1 cm nozzle to allow the packet to be squeezed without nozzle deformation. And, the selected packet design has gussets on the sides to increase volume while minimizing internal surface area, so that material can be dispensed by one hand finger compression.

Example 2

A resulting design was functionally tested by others that represented a consumer panel. Ten packets of the design were distributed among 6 persons of the panel. Each person was instructed to express material from a packet according to a procedure of manually pressing the packet with one hand with an index finger along the crease to fold the packet longitudinally to express the sealant from the packet nozzle.

A jury of designers observed from the expressing procedures and noted the panel's comments. The consumer panel responses were filmed to capture use of the packet and comments The panel approved the proposed design. The following panel comments on the design were recorded: "This is really nice! I'm digging this." "I think that's kind of amazing. I can only say good things about it." "Super easy to use. I love the bead that it gave me. If feels like I have a lot of control." "I like this already, and I'll tell you why. Because you can really manipulate the pressure. You can do a lot, or you can do a little." "You've addressed the issue of most people at home not needing a huge quantity [of caulk]." "Once you get used to using these, as you can see already on my first run, you're pretty much a professional."

This EXAMPLE illustrates a prospective commercial success for a viscous dispenser according to the invention.

While preferred embodiments of the invention have been described, the present invention is capable of variation and modification and therefore should not be limited to the precise details of the Examples. The invention includes changes and alterations that fall within the purview of the following claims.

What is claimed is:

1. A method of applying a sealant to substantially empty a sealant packet without retain unused sealant, comprising:

identifying a sealant job;

identifying an amount of sealant to complete the identified sealant job without substantial unused sealant;

selecting a packet containing only an amount of sealant that substantially matches the identified amount of sealant to accomplish the identified job without substantial unused sealant from a sealant kit containing a plurality of sealed packets wherein at least one packet differs in size and contains a different amount of sealant than at least one other packet; and folding a semi-rigid plastic backing to express sealant from the packet, to substantially empty the packet and to complete the job.

2. The method of claim 1, wherein the at least one packet has dimensions of 8 cm by 6 cm or smaller.

3. The method of claim 1, wherein the at least one packet has dimensions of 20 cm to 4 cm by 15 cm to 2 cm with a filled thickness of 0.5 cm to 2 cm.

4. The method of claim 1, wherein the at least one packet has dimensions of 20 cm by 15 cm or smaller, containing an amount of caulk sealant to seal an identified job without substantial unused sealant.

5. The method of claim 1, wherein the semi-rigid plastic backing is flexible to be collapsed against itself and creased at a crease line.

6. The method of claim 1, wherein the at least one packet holds a sealant comprising an RTV composition.

7. The method of claim 1, wherein the at least one packet holds a sealant comprising a polysiloxane component comprising a mixture or reaction product of (i) a polysiloxane polymer having hydrolysable substituent groups and (ii) a polyfunctional silicon compound having two or more hydrolysable substituent groups.

8. The method of claim 1, wherein the at least one packet holds a sealant comprising a polysiloxane component comprising a mixture or reaction product of (i) a polysiloxane polymer having hydrolysable substituent groups and (ii) a polyfunctional silicon compound having two or more hydrolysable substituent groups and includes a filler and a condensation cure catalyst.

9. The method of claim 1, wherein the at least one packet comprises a longitudinal axis and an interior, the packet including a top sidewall including the semi-rigid plastic backing, a bottom sidewall, a first closure forming a downstream end of the packet and a second closure forming an upstream end of the packet, a dispensing extension to the semi-rigid plastic backing in a nozzle form extending outwardly from the backing and having a flow passageway in fluid communication with the interior.

10. The method of claim 9, comprising a sealant contained in an interior of the at least one packet, the semi-rigid plastic backing being fabricated out of a flexible material whereby the packet may be manually folded to squeeze the sealant as an applied bead out of the packet and onto a selected substrate surface.

* * * * *